252-99 AU 165 EX
11/2/76 XR 3,989,638

United States Patent [19]
Bradley et al.

[11] 3,989,638
[45] Nov. 2, 1976

[54] BLEACHING ARTICLE

[75] Inventors: William Jack Bradley; Mario Stephen Marsan, both of Cincinnati, Ohio

[73] Assignee: The Procter & Gamble Company, Cincinnati, Ohio

[22] Filed: Mar. 27, 1975

[21] Appl. No.: 562,528

[52] U.S. Cl. ..... 252/186; 8/111; 252/90; 252/95; 252/99; 252/187 H

[51] Int. Cl.[2] ..... C11D 3/395; C11D 7/54; D06L 3/08; D06L 3/02

[58] Field of Search ..... 252/186, 187 H, 90, 252/95, 99, 316, 317; 8/111, 79

[56] References Cited

UNITED STATES PATENTS

| | | | |
|---|---|---|---|
| 3,684,722 | 8/1972 | Hynam et al. | 252/99 |
| 3,708,260 | 1/1973 | Marshall | 252/316 |
| 3,726,967 | 4/1973 | Vorsatz et al. | 252/186 |
| 3,789,002 | 1/1974 | Weber et al. | 252/316 |
| 3,843,548 | 10/1974 | James | 252/187 H |

*Primary Examiner*—Benjamin R. Padgett
*Assistant Examiner*—Irwin Gluck
*Attorney, Agent, or Firm*—Charles R. Wilson; Jerry J. Yetter; Richard C. Witte

[57] ABSTRACT

Articles releasably containing starch-thickened peroxygen bleaches are provided.

15 Claims, No Drawings

BLEACHING ARTICLE

BACKGROUND OF THE INVENTION

The present invention encompasses articles designed to deliver a pre-determined amount of a bleaching composition. More specifically, articles comprising starch-thickened peroxygen bleaches releasably contained in a receptacle are distributed evenly over fabrics by the tumbling action of an automatic clothes dryer. The articles can also be used to deliver a pre-measured amount of bleach to a laundry bath.

Compositions and processes designed to provide desirable functional and aesthetic benefits to fabrics are conventionally employed in a washing machine. Thus, fabric sizings, softening agents, bleaches, brighteners, and the like, are commonly formulated and provided as compositions designed for use either in an aqueous laundering liquor or in an aqueous rinse bath. More recently, the treatment of fabrics in automatic clothes dryers has been shown to be an effective means for imparting desirable properties thereto. For example, it is becoming common to soften fabrics in an automatic clothes dryer rather than during the rinse cycle of a laundering operation. In either mode of treating fabrics it is convenient to provide the user with a pre-determined amount of the fabric treating agent so that measuring and under-usage are avoided.

By the present invention, a pre-measured amount of a bleaching composition comprising a highly effective peroxygen bleach incorporated into a starch-thickened carrier is placed in a dispensing means to provide a bleaching article. The article is used to bleach fabrics in an aqueous laundry bath at alkaline pH's (e.g., in the presence of standard detergents or pre-soaks which provide a pH in the alkaline range), or in a clothes dryer at elevated temperatures. The starch-thickened bleaches herein are exceptionally stable from the standpoint of both peroxygen bleach stability and stability of the overall, thickened compositions. Accordingly, the present articles are characterized by their exceptionally good shelf-life. Most importantly from the standpoint of a dryer-added bleaching product, the starch-thickened bleaches herein do not cause substantial visible damage to fabric dyes.

The concurrently-filed applications of Diehl, et al., and Marsan, et al., Ser. Nos. 562,527 and 562,529, relate to dryer-added bleaching articles containing thickened bleaches.

The concurrently-filed application of Bradley, Ser. No. 562,531, relates to a starch-thickened bleach for use in an aqueous laundry bath.

The concurrently-filed application of Edwards, et al., Ser. No. 562,530, relates to non-starch thickened bleaches used in laundry baths.

U.S. Pat. No. 3,701,202 describes a dispensing article for use in an automatic clothes dryer and suggests that fabrics may be softened, bleached and otherwise desirably treated in the dryer by means of such an article. See also, U.S. Pat. No. 3,180,037.

The co-pending application of Diehl and Edwards, Ser. No. 437,569, filed Jan. 29, 1974, discloses certain solid, dryer-added peroxygen bleaches which provide substantial bleaching superiority over dry bleaching compositions employed in a laundering liquor.

The co-pending application of Lucas, McKenna and Diehl, Ser. No. 437,570, filed Jan. 29, 1974, discloses bleaching articles comprising a porous pouch containing a solid, activated bleach.

U.S. Pat. No. 3,843,548, entitled COMPOSITIONS CONTAINING A SOURCE OF HYPOCHLORITE IONS, to R. James, issued Oct. 22, 1974, discloses clay-thickened hypochlorite bleaches. Hydrogen peroxide bleaches thickened with silica gel are known in the hair bleaching art. German Pat. No. 2,408,636, published Sept. 5, 1974, U.S. application Ser. No. 335,311, Feb. 23, 1973, relates to the use of fabric treating agents other than bleaches encapsulated with various organic gelling agents and used, in solid form, in a clothes dryer.

The following references generally relate to peroxygen compounds and their use as oxidizing agents and/or bleaches: Canadian Pat. No. 635,620 to H. W. McCune, issued Jan. 30, 1962; British Pat. No. 847,702, issued Sept. 14, 1960; W. E. Parker, et al., *J. Am. Chem. Soc.*, 79, 1929 (1957); E. Searles, "Preparation, Properties, Reactions and Use of Organic Peracids and their Salts," FMC Corp., N.Y. (1964); D. Swern (ed.) "Organic Peroxides", Vol. I, Wiley-Interscience, N.Y. (1970).

It is an object of this invention to provide a means for dispensing fabric bleaches in an even and efficient manner without recourse to complicated dispensers or machine modifications.

It is another object to provide color-safe, yet effective, fabric bleaches in releasable combination with a simple, economical dispensing means.

These and other objects are obtained herein as will be seen from the following disclosure.

SUMMARY OF THE INVENTION

The present invention encompasses articles which can be used to remove stains from fabrics. The articles herein can be used in an automatic clothes dryer by commingling pieces of damp fabrics therewith by the tumbling action of the dryer. The starch-thickened bleach present in the articles is rapidly and evenly distributed over all fabric surfaces. Alternatively, the article can be placed in a washing machine to deliver a pre-determined amount of the bleaching composition to the laundry bath.

DETAILED DESCRIPTION OF THE INVENTION

The through-the-dryer fabric bleaching process of the present invention is carried out by contacting damp fabrics with an effective amount of a bleaching composition using an article of the type described hereinafter. It is an essential feature of the present process that the fabrics to be dryer-bleached must be damp when contacted by the bleaching composition, inasmuch as water provides the reaction medium in which the bleaching process occurs. The damp fabrics employed in the dryer bleaching process are most commonly those secured by washing, rinsing and spin-drying fabrics in any standard washing machine. Such fabrics will contain from about 50 to 200% by weight of water, based on dry fabric weight. Of course, it is most convenient to bleach fabrics in the foregoing manner after a laundering and spin-drying operation, and concurrently with drying the laundered fabrics with hot air. Moreover, the heat used to dry fabrics enhances the bleaching action of the peroxygen bleaches. The net result of bleaching with peroxygen bleaches using the minimal amounts of water retained by the damp fabrics (higher relative effective concentrations of the bleach) and high temperatures (commonly 50° C to 80° C) in the dryer is that performance equivalent to hypochlorite bleach is secured.

"Spottiness" caused by uneven distribution of bleaches over all fabric surfaces is unacceptable to the user of dryer-added products. It will be appreciated that the problem of providing even bleach distribution in the presence of but minimal amounts of water in the manner of the present dryer bleaching process is substantial. The problem becomes particularly acute when a simple, inexpensive, disposable means for distributing a bleach is desired.

While through-the-wash bleaching processes do not engender the same problems as dryer bleaching, it is important that washer bleaches be stable on storage, safe to fabrics and colors, yet effective for removing a variety of stains from a spectrum of fabric types.

It has now been found that starch-thickened compositions containing particulate, substantially water-insoluble peroxygen bleaches and formulated in combination with a simple dispensing means provide stable articles which evenly, effectively, and safely bleach fabrics. The articles can be used in a washer or in a dryer. The components of the thickened bleaches and dispensing means which comprise the articles herein are described, in turn, below.

BLEACHING COMPOSITIONS

The present articles comprise an effective amount of a stable, color-safe, yet effective fabric bleaching composition, comprising:

a. an effective amount of a solid, substantially water-insoluble peroxygen compound;
b. an effective amount of a starch thickening agent; and
c. a liquid carrier (most preferably water), said bleaching composition being in releasable combination with a water-insoluble dispensing means.

The peroxygen bleaching compounds used in the present articles can be any of the well-known organic peroxides which are substantially water-insoluble, and which decompose under alkaline conditions or heat to provide active (presumably, singlet) oxygen which serves to bleach stains. (By "substantially water-insoluble" herein is meant a water solubility of less than about 1% wt. at room temperature.) Such organic peroxide materials include, for example, the alkyl, alkenyl, alkynyl, cycloalkyl, cycloalkenyl, aralkyl, aralkenyl and heterocyclic hydroperoxides; the acyclic, cycloalkyl and aralkyl $\alpha$-oxyhydroperoxides and the gem-dihydroperoxides; the cyclic peroxides such as 1,2,4-trioxacyclopentane; the $\alpha$-oxyperoxides; and $\alpha$-oxoperoxides; the $\alpha,\alpha'$-dioxyperoxides and $\alpha,\alpha'$-diperoxyperoxides; the $\alpha,\alpha'$-dioxoperoxides; and the $\alpha,\alpha'$-dialkoxy-$\alpha,\alpha'$-dioxoperoxides, well-known in the scientific literature. For typical listings of such compounds, see ORGANIC PEROXIDES THEIR FORMATION AND REACTIONS, E. G. E. Hawkins, D. Van Nostrand Company Ind., 1961, incorporation herein by reference.

It is to be understood that the present compositions can be prepared with any of the foregoing types of solid peroxides as the peroxygen bleaching agent, so long as the peroxide selected is substantially water-insoluble and decomposes to provide the active oxygen bleaching species. Of course, it will be appreciated that certain organic peroxides are expensive; others are difficult to prepare on a commercial scale; still others are overly toxic or decompose to toxic and/or malodorous or otherwise undesirable by-products. While such factors are not important to the functioning of the present articles, they must be considered when selecting preferred peroxides for home use as bleaches.

The most highly preferred peroxides for use as the peroxygen bleaching agent in the present compositions are the peroxyacids. Peroxyacids are conveniently prepared by the reaction of carboxylic acids with hydrogen peroxide in the presence of sulfuric acid, and many such materials are commercially available. The peroxyacids, as a class, are quite effective bleaches. In general, peroxyacids containing at least about 8 carbon atoms are sufficiently insoluble in water for use herein. The common alkali metal and ammonium salts of the peroxyacids are, for the most part, too water-soluble and are not used in the instant compositions.

Typical monoperoxyacids (i.e., prepared from monocarboxylic acids) useful herein include alkyl peroxyacids, alkenyl peroxyacids and aryl peroxyacids. Nonlimiting examples of peroxyacids useful herein include peroxymyristic acid, peroxystearic acid, peroxyoleic acid and peroxy-$\alpha$-naphthoic acid.

Typical diperoxyacids (i.e., prepared from dicarboxylic acids) useful herein include alkyl diperoxyacids, alkenyl diperoxyacids and aryl diperoxyacids. Nonlimiting examples of diperoxyacids useful herein include diperazelaic acid, diperbrassylic acid, dipersebacic acid, and diperisophthalic acid. The diperoxyacids are preferred over the monoperoxyacids in that, on a mole basis, the di-acids provide two equivalents of active oxygen, whereas the mono-acids provide one.

Diperazelaic acid can be readily obtained by the reaction of hydrogen peroxide and sulfuric acid with azelaic acid which, in turn, is obtained by the catalytic oxidation of 9,10-dihydroxystearic acid; see U.S. Pat. No. 3,855,257, issued Dec. 17, 1974, to E. P. Pultinas, Jr., incorporated herein by reference. Diperazelaic acid is preferred for use herein by virtue of its low solubility in water and superior bleaching performance.

The bleaching compositions used in the present articles preferably comprise from about 5 to about 35%, more preferably about 15 to about 25%, by weight of the peroxygen bleaching compound.

The peroxygen bleaching compositions used herein are thickened, or even gelled, and are characterized by a viscosity (Brookfield) in the range of about 200 centipoise (cps) to about 100,000 cps, preferably about 1000 cps to about 20,000 cps.

The thickened bleaches can be prepared by suspending the active bleaching compound in water or any other non-solubilizing liquid carrier, e.g., 95:5 (wt.) water-ethanol, or the like, and thickening the suspension with starch. The term "starch" as used herein includes natural and refined starches such as corn (preferred), rice, and wheat starches, as well as various derivatized starches such as starch esters, modified starches and coated starches which are known as thickeners for water and like carrier materials used herein.

More specifically, commercial starches useful herein include unmodified food grade starches obtained from corn, wheat and rice, as well as tapioca starches, cow soapwort (*Saponaria vaccaria*) starch, potato starch and the like. Such starches are well known for their swelling and thickening properties and are commercially available as easily used powders.

Derivatized and cross-linked starches are also well known thickening agents and such materials are also useful herein. Acetylated corn, wheat and rice starches, chlorohydrin cross-linked corn, wheat and rice starches and coated starches such as DRY-FLO starch are useful thickeners herein.

The unmodified starches, especially corn starch, are especially preferred herein in that they provide surprisingly stable compositions, as compared with non-starch thickeners.

The compositions used in the present articles comprise from about 1% to about 25%, more preferably about 8% to about 15%, by weight of the starch thickener. More or less can be employed, depending on the thickening power of the starch selected for use.

The liquid carrier is selected from non-toxic, nonflammable liquids suitable for use in contact with fabrics, and which can be gelled with starch, but which do not dissolve the solid peroxygen compounds used herein as bleaches. Water is the most highly preferred carrier herein, but other liquids can be employed if they meet the above criteria. The liquid carrier comprises about 40 to 90% by weight of the instant compositions.

As in the case of most peroxygen compounds, decomposition of the bleaches herein is catalyzed by "heavy" metal ions. In order to help provide storage-stable compositions, contamination by even trace amounts of metal ions is preferably avoided. Metal ion contaminants can be removed from the instant compositions by the use of effective amounts of various well-known chelating agents. However, it is to be understood that the starches themselves, especially corn starch, provide exceptionally stable compositions even without resorting to chelating agents.

Typical optional chelating agents useful herein include ethylenediaminetetraacetic acid, and its alkali metal salts; nitrilotriacetic acid, and its alkali metal salts; and like chelators well known in the art. For most purposes, from about 0.05 to about 1% of chelator by weight of the composition removes all metal ion contaminants; more or less can be used, depending on the degree of metal ion contamination.

Other optional ingredients which can be used in the instant articles include effective amounts of various laundry adjunct and fabric treating agents not commonly found in bleaches. Such materials can be used without the problem of undesirable interactions with the active bleaching agent, since the bleaching agent is present in an undissolved state. Typical, optional additives herein can include fumigants, fungicides, soil suspending agents, optical bleaches, disinfectants, and the like, well known in the detergency arts. For most purposes, such optional ingredients will comprise a minor, but effective, amount of the compositions herein, usually from about 0.05 to about 5% by weight.

A particularly desirable attribute of the bleach compositions used in the instant articles is their substantial lack of odor. Again, since the bleaching compounds are in a stable state they do not interact with the complex organic molecules present in desirable odoriferous and perfume compositions. Accordingly, it will be appreciated that the compositions used herein can be desirably perfumed and will retain a stable odor throughout their shelf life. This important attribute is to be contrasted with hypochlorite bleaches, which are inherently malodorous and which cannot be effectively perfumed due to oxidative decomposition of perfume components.

Preferred bleaches used in the present articles will contain an odoriferous amount, i.e., from about 0.01 to about 5%, preferably 0.05 to about 1%, by weight of a perfume component. The perfume component can comprise a relatively complex mixture of odoriferously desirable components, e.g., jasmine, rose extract, sandalwood oil, and the like. Alternatively, relatively simple perfume ingredients which connote cleansing can be used, e.g., terpene mixtures (pine oil), lemon oil, and the like.

As can be seen from the foregoing, the bleach compositions used herein comprising the solid, water-insoluble peroxygen compound, the starch thickening agent, the liquid carrier, and the various optional adjuncts, can be formulated from materials which are readily available. Highly preferred compositions are those wherein the peroxygen compound is a peroxyacid, especially diperoxyacids such as diperazelaic acid (most preferred), diperbrassylic acid, dipersebacic acid and diperisophthalic acid. To enhance the efficiency of the bleaches, it is preferred that they be in a fairly fine, granular state, but this is not critical to the practice of the invention. For the most part, the peroxygen compounds have an average particle size below about 1500 microns; most preferably, the diperoxyacids used herein have a particle size below about 1000 microns, generally in the range from about 1 micron to about 1000 microns. Peroxygen compounds which pass a 20 mesh sieve work well herein, as do those which pass a 200 mesh sieve. Highly preferred compositions used herein contain from about 5 to about 35% by weight of the peroxygen compound, and most preferably comprise from about 15 to about 25% by weight of a diperoxyacid.

The most highly preferred bleach compositions for use in the present articles by virtue of their stability and long shelf-life comprise from about 20% to about 30% by weight of a particulate diperoxyacid; from about 5 to about 20%, more preferably from about 10 to about 15%, by weight of corn starch; the balance of the composition comprising water, which is a highly preferred liquid carrier herein.

When preparing optimal compositions of the present type, it is most preferred to use diperazelaic acid having an average particle diameter in the range from about 10 microns to about 1000 microns. Such compositions comprising the diperazelaic acid, corn starch thickener, and water carrier also preferably contain an odoriferous amount of a perfume component. Optimal compositions herein will contain, as an additional component, an effective amount of a metal chelating agent, whereby the compositions are substantially free of heavy metal cations.

The bleach compositions for use in the articles herein can be prepared by simply blending the ingredients. In the most preferred method of preparation, the starch thickener is added to the water carrier and blended until a homogeneous system thickened to the desired degree is secured. The peroxygen compound is added together with any optional ingredients, and the composition is blended until homogeneous. Of course, the compositions are nonalkaline, since alkalinity causes decomposition of the peroxygen compounds.

ARTICLE PREPARATION AND USAGE

The articles of the present invention are prepared by fashioning a receptacle of the type described hereinafter which serves as a dispensing means, and enclosing therein an effective amount of the bleaching composition. By an "effective amount" of the bleaching composition is meant an amount sufficient to remove the stains from an average load of fabrics in an automatic washer or automatic dryer. Of course, the actual amount of the bleaching composition employed will depend on the fabric load, the amount of stain to be removed, and the bleaching composition selected for use in the article. For an average 5–10 pound load of medium- to heavily-stained fabrics, from about 10 grams to about 50 grams, preferably 20 grams to 30 grams, of the bleaching compositions herein provide good stain removal.

When preparing the articles for use in dryers, the rate of release of the bleaching composition from the dispensing means is preferably optimized. The rate of release should not be so fast that the composition is deposited in an uneven manner on the fabrics. Conversely, the rate of release of the bleaching composition must not be too slow, since all, or substantially all, of the composition is to be dispensed onto the fabrics while they are still damp. The rate of release of the bleaching composition depends on both the viscosity of the bleach composition and the size of the openings in the dispensing means.

When the article is to be used in a washing machine, the rate of release is not as critical as with a dryer-added article. However, it is preferred that substantially all of the bleaching composition be dispensed within the first few minutes of an average (ca. 14-minute) washing cycle.

The dispensing means herein can be provided in a variety of sizes and shapes, and the particular configuration is not critical to the practice of this invention. For example, a dispensing means can be provided wherein only one wall, or a portion of one wall, comprises a material having porous openings through which the bleaching composition is dispensed. Preferably, the whole of the dispensing means comprises a material provided with openings through which the bleaching compositions can pass when agitated, e.g., by the tumbling action of the dryer.

In its simplest and preferred aspect, the dispensing means herein is prepared in the form of a pouch. Preferred dispensing means comprise a flexible embossed plastic pouch containing the bleaching composition. The pouch, which can be made from any water-insoluble plastic sheeting which will maintain its integrity under dryer heat, is formed by folding the embossed sheet into the desired pouch or pouch-like configuration and sealing the edges, for example by heat-sealing, leaving an opening along one edge. The bleaching composition is added to the pouch through the opening, which is then sealed. The resulting pouch is stretched immediately prior to use to cause pores or perforations to open along the embossing lines. The pouch releases the bleaching composition through its now-perforate walls on agitation, e.g., by the tumbling action of an automatic dryer. Suitably embossed plastic sheets for preparing the pouch receptacle include, for example, polyethylene, polypropylene, and the like, and are available from Hercules as INSTANTNET, DELNET brand. When ruptured along the embossed pattern lines, such sheets form pores or perforations in the size range of 0.05-3 mm useful herein.

Alternatively, water-insoluble plastic pouches having perforations in the range of ca. 0.05 to ca. 3 mm are used herein. Such pouches can be covered and sealed with plastic film which is removed at time-of-use.

A typical bleaching article herein comprises: (a) a water-insoluble, closed, flexible pouch, the walls of said pouch consisting of uniformly perforated or perforatable polyethylene (e.g., INSTANTNET, above) wherein the diameter of the perforations is about 0.05–0.5 mm; and (b) a bleaching amount of a corn starch-thickened fabric bleaching composition comprising, as the bleaching agent, diperazelaic acid, and water as the liquid carrier, said bleaching composition being characterized by a viscosity in the range of 1000 to 100,000 cps, preferably 1500–4000 cps.

The articles herein are used in the following manner. Damp fabrics, usually containing from about 1 to 1.5 times their weight of water, are placed in the drum of an automatic clothes dryer. The perforations in the bleaching article are opened and the article is placed in the dryer, which is then operated in standard fashion to dry the fabrics, usually at a temperature from about 50° to about 80° C for a period of from about 5 minutes to about 50 minutes, depending on the fabric load and type. The tumbling action of the revolving dryer drum commingles the bleaching article with the fabrics and evenly dispenses the bleaching composition on the fabric surfaces. The washer-added articles herein are used in similar fashion in a washing machine, preferably in combination with a detergent.

The most highly preferred articles herein are those having, in use, at least 30% of their total surface area perforated in a more-or-less uniform fashion, and wherein the perforations have a diameter of 0.5 to 1 mm. (Such articles can be fashioned from the INSTANTNET, above, or can be perforated at the outset.) When used in the foregoing manner, such articles provide even distribution of the thickened bleaches herein over all fabric surfaces.

The following examples illustrate the present invention but are not intended to be limiting thereof.

EXAMPLE I

An article of the present type comprising a starch gel in an embossed pouch which opens to provide numerous holes on extension is as follows:

| Ingredient | % (wt.) |
|---|---|
| Diperazelaic acid* | 15.25 |
| Corn starch | 12.67 |
| Perfume | 0.3 |
| Water | Balance |

*Passes 150, retained on 200 ASTM sieve.

The composition of Example I is prepared by simply mixing the indicated ingredients until a thick, homogeneous semi-gelatinous mass is secured.

Twenty grams of the bleaching gel secured in the foregoing manner are placed in a pouch. Conveniently, the pouch is ca. 0.08 mm thickness polyethylene embossed in a regular pattern almost to the point of rupture (INSTANTNET, DELNET Brand, Hercules, Inc.). The pouch is in the form of a trapezoid. In use, the pouch is stretched to rupture along the embossed pattern lines, whereupon multiple, ca. 1 mm perforations are opened to provide a means for releasing the gel.

A pouch prepared in the foregoing manner and ruptured along the embossing lines is placed together with 10 lbs. of damp (15 lbs. water) fabrics in a standard automatic clothes dryer. The dryer is operated in standard fashion for 40 minutes at an average temperature of 60°–70° C, with tumbling and venting. Substantially all the gel is uniformly distributed over the fabrics during the first 5 minutes of tumbling, i.e., while the fabrics are still quite damp.

After the drying cycle is complete, the fabrics are removed and are found to have been uniformly bleached, without substantial spotting. The bleaching action is quite comparable to that obtained when commercial hypochlorite solutions are used according to manufacturers' instructions to bleach fabrics in a washing machine.

In the article of Example I, the corn starch is replaced by an equivalent amount of the following thickeners, respectively, and excellent results are secured: wheat starch; rice starch; potato starch; and tapioca starch.

EXAMPLE II

An article of the present type comprising a particulate peroxyacid suspended in a gel matrix and releasably enclosed in a porous pouch is as follows:

| Ingredient | % (wt.) |
|---|---|
| Diperazelaic acid* | 20.0 |
| Corn starch | 12.0 |
| Ethylenediaminetetraacetate, sodium salt (EDTA) | 0.5 |
| Water | Balance |

*Passes 20, retained on 200 ASTM sieve.

The composition of Example II is prepared by mixing the water, corn starch, and ethylenediaminetetraacetate until a syrupy consistency is achieved. The particulate diperazelaic acid is thereafter added, and stirring is continued until a homogeneous system is secured.

Thirty grams of the bleaching composition prepared in the foregoing manner are placed in a 4 × 4 in. porous pouch of the type described in Example I. The pouch has ca. 150 holes uniformly over its surface, said holes having an average diameter of ca. 2 mm. The pouch is covered with polyethylene film to retain the gel until time-of-use.

The covering film is removed from the pouch prepared in the foregoing manner, and the pouch is placed together with 10 lbs. of fabrics in a standard automatic washer (ca. 25 gal. of water). A commercial, phosphate-built detergent (1.25 cups) is added; the pH of the wash liquor is ca. 9.5. The washer is operated in standard fashion, with agitation, for 14 minutes at an average water temperature of 110° F. Substantially all the diperazelaic gel is uniformly distributed throughout the bath during the first 3 to 5 minutes of the washing cycle.

After rinsing and spin-drying is complete, the fabrics are removed and tea, coffee and wine stains present thereon are found to have been uniformly bleached, without substantial spotting. The bleaching action is quite comparable to that obtained with commercial hypochlorite solutions used according to manufacturers' instructions to bleach fabrics in a washing machine. No substantial fabric color damage is observed.

In the article of Example II, the diperazelaic acid is replaced by an equivalent amount of diperisophthalic acid and diperbrassylic acid, respectively, and equivalent results are secured.

What is claimed is:

1. A fabric bleaching article comprising an effective amount of a bleaching composition having a viscosity of from about 200 cps to about 100,000 cps, comprising:

a. an effective amount of a solid, substantially water-insoluble peroxygen compound;

b. an effective amount of a starch thickening agent; and c. a liquid carrier, wherein said bleaching composition is in releasable combination with a water-insoluble dispensing means characterized by being in the form of a pouch having perforations of a diameter from about 0.05 to about 3 mm or embossed in such a manner that upon rupture perforations are formed having a diameter of from about 0.05 to about 3 mm.

2. An article according to claim 1 wherein the water-insoluble peroxygen compound represents from about 5 to about 35% by weight of the composition and the starch thickening agent represents from about 1 to about 25% by weight of the composition.

3. An article according to claim 2 wherein the peroxygen compound is a peroxyacid.

4. An article according to claim 3 wherein the peroxyacid is a diperoxyacid.

5. An article according to claim 4 wherein the diperoxyacid is selected from the group consisting of diperazelaic acid, diperbrassylic acid, dipersebacic acid, and diperisophthalic acid.

6. An article according to claim 5 wherein the solid diperoxyacid is characterized by an average particle diameter below about 1500 microns.

7. An article according to claim 1 wherein the thickening agent is selected from corn, wheat, rice, potato and tapioca starches, and derivatives thereof.

8. An article according to claim 7 wherein the thickener is corn starch and comprises from about 5% to about 20% of the bleaching composition.

9. An article according to claim 1 wherein the liquid carrier is water.

10. An article according to claim 1 wherein the pouch comprises flexible plastic embossed in a regular pattern.

11. An article according to claim 10 whereby the pouch, on rupture, has at least 30% of its total surface area comprised of holes having an average diameter of from about 0.5 to about 1 mm.

12. An article according to claim 10 wherein the bleaching composition comprises from about 20% to about 30% by weight of a particulate diperoxyacid; from about 10% to about 15% by weight of corn starch; the balance of the composition comprising water.

13. An article according to claim 12 wherein the diperoxyacid is diperazelaic acid.

14. An article according to claim 13 containing, as an additional component, an odoriferous amount of a perfume component.

15. An article according to claim 14 comprising, as an additional component, an effective amount of a metal chelating agent, whereby the bleaching composition is substantially free of heavy metal cations.

* * * * *